US009539711B2

(12) United States Patent
Chen

(10) Patent No.: US 9,539,711 B2
(45) Date of Patent: Jan. 10, 2017

(54) BIT FOR REMOVING DAMAGED SCREWS

(71) Applicant: JEI MOU INDUSTRIAL CO., LTD., Taichung (TW)

(72) Inventor: Bo-Shen Chen, Taichung County (TW)

(73) Assignee: Jei Mou Industrial Co., Ltd., Taichung (TW)

( * ) Notice: Subject to any disclaimer, the term of this patent is extended or adjusted under 35 U.S.C. 154(b) by 302 days.

(21) Appl. No.: 14/495,496

(22) Filed: Sep. 24, 2014

(65) Prior Publication Data

US 2016/0082579 A1 Mar. 24, 2016

(51) Int. Cl.
*B25B 27/18* (2006.01)
*B25B 15/00* (2006.01)

(52) U.S. Cl.
CPC ..... *B25B 27/18* (2013.01); *B25B 15/002* (2013.01)

(58) Field of Classification Search
CPC ..... B25B 27/18; B25B 15/002; B25B 13/50; B23B 51/00; B23B 51/02; B23B 51/009; B23B 51/0081; B23B 51/0009; B23B 51/10
See application file for complete search history.

(56) References Cited

U.S. PATENT DOCUMENTS 6,761,089 B2 * 7/2004 Bergamo ..... B25B 27/18 81/441
6,978,697 B2 * 12/2005 Kozak ..... B23B 51/00 81/441
7,000,501 B1 * 2/2006 Chen ..... B25B 27/18 7/158
7,152,509 B2 * 12/2006 McCalley, Jr. ..... B25B 27/18 81/441
7,171,871 B2 * 2/2007 Kozak ..... B23B 51/00 81/441
8,215,206 B2 * 7/2012 Kozak ..... B25B 27/18 81/441
8,276,482 B2 * 10/2012 Kozak ..... B23B 51/00 81/441
8,485,066 B2 * 7/2013 Kozak ..... B23B 51/00 81/441
2006/0150780 A1 * 7/2006 Chen ..... B23B 51/00 81/53.2
2008/0105092 A1 * 5/2008 Chen ..... B25B 27/18 81/53.2

* cited by examiner

*Primary Examiner* — David B Thomas
(74) *Attorney, Agent, or Firm* — Wang Law Firm, Inc.

(57) ABSTRACT

A bit for removing damaged screws includes: a shaft portion and a head portion connected to the shaft portion. The head portion includes a tip section, a threaded conical section, and scraping portions extending continuously from the tip section to the threaded conical section. The scraping portions are able to perform continuous and non-stopping scraping operation toward the damaged screw. The scraping portions on the threaded conical section can scrape out a space big enough to allow passage of the threaded conical section, thus reducing resistance when the threaded conical section performs scraping and cutting operation. The threaded conical section can be guided to bite into and unscrew out the damaged screw, right after the scraping operation is performed by the tip section, so that the scraping and unscrewing operation can be performed more smoothly.

2 Claims, 14 Drawing Sheets

BIT FOR REMOVING DAMAGED SCREWS

BACKGROUND OF THE INVENTION

Field of the Invention

The present invention relates to a tool for removing damaged fasteners, and more particularly to a bit for removing damaged screws.

Description of the Prior Art

Screws are widely used fasteners with a driving groove, via which, the screws can be rotated by a screwdriver. However, the driving groove of the screws may be damaged due to many reasons, for example, user's overexertion during rotation, screwdriver doesn't fit the size or shape of the driving groove. Once the driving groove is broken or damaged, the screw can not be rotated by an ordinary screwdriver anymore, and can only be removed by a professional bit which is particularly designed to remove damage screws.

FIG. 1 shows a conventional bit 10 for removing a damaged screw A, wherein the bit 10 includes a head portion 11 and a shaft portion 12. The head portion 11 is sequentially provided with a front end section 111, a shrinking neck section 112 and a reversely threaded section 113. The front end section 111 is provided with two scraping edge 114. The shrinking neck section 112 is located between the front end section 111 and the reversely threaded section 113. The diameter of both ends of the shrinking neck section 112 is smaller than that of the front end section 111 and the diameter of the connection between the reversely threaded section 113 and the shrinking neck section 112, so that the front end section 111, the shrinking neck section 112 and the reversely threaded section 113 define a recess 115. The reversely threaded section 113 is connected to the shaft portion 12, and the thread of the reversely threaded section 113 is a reversely thread with respect to the thread of the damaged screw A, namely the reversely threaded section 113 rotates in a reverse direction with respect to the thread of the damaged screw A. The bit 10 can use the scraping edges 114 to dig into the driving groove A1 of the damaged screw A, then the bit 10 keeps rotating to make the reversely threaded section 113 bite into and unscrew the damaged screw A.

This bit 10 is able to remove the damaged screw A. When the bit 10 rotates, the two scraping edges 114 firstly cut into the damaged driving groove A1 (namely, the scraping edges 114 are mainly responsible for scraping operation), then the reversely threaded section 113 bits into the driving groove A1 which has been scraped, and the reversely threaded section 113 is responsible for screwing into and driving the bit to move forward. Due to the fact that the scrapping edges 114 are separated from the reversely threaded section 113 by the shrinking neck section 112, the two scraping edges 114 only extend to he shrinking neck section 112, and the reversely threaded section 113 is located behind the shrinking neck section 112, the scraping operation performed by the scrapping edges 114 will stop before the shrinking neck section 112, and the cutting operation performed by the reversely threaded section 113 starts only after the shrinking neck section 112. Therefore, the shrinking neck section 112 becomes an idle rotation section or period (during which no scraping operation is performed) when the bit 10 is screwing in the damaged screw A, as a result, the reversely threaded section 113 will bear extremely large resistance.

The present invention has arisen to mitigate and/or obviate the afore-described disadvantages.

SUMMARY OF THE INVENTION

The primary objective of the present invention is to provide a bit for removing damaged screws, which is able to overcome the problem that the conventional bit for removing damaged screws is likely to cause undesired movement and non-scraping idle rotation period during scraping operation, which then results in large resistance and makes the bit difficult to use.

To achieve the above objective, a bit for removing damaged screws in accordance with the present invention comprises: a shaft portion and a head portion connected to the shaft portion. The head portion includes a middle axis and is provided with a tip section and a threaded conical section connected between the tip section and shaft portion. The tip section includes a vertex point. An outer peripheral surface of the threaded conical section defines an angle with respect to the middle axis. The threaded conical section expands toward the shaft portion, and is a conical structure with a reverse thread. The bit is characterized in that;

the head portion is provided with two symmetrical scraping portions extending continuously from the tip section to the threaded conical section, the two scraping portions each include a first scraping surface, a residual portion and a second scraping surface, the residual portion is a structure formed at a connection where the first and second scraping surfaces are connected to each other at an angle, the first scraping surface intersects with the tip section, the threaded conical section and a first connecting surface of the residual portion, a first scraping edge is formed at a position where the first scraping surface intersects the tip section, and extends between the vertex point and the threaded conical section, the second scraping surface intersects with the tip section, the threaded conical section and a second connecting surface of the residual portion, a second scraping edge is formed at a position where the second scraping surface intersects the tip section, and extends between the vertex point and the threaded conical section.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
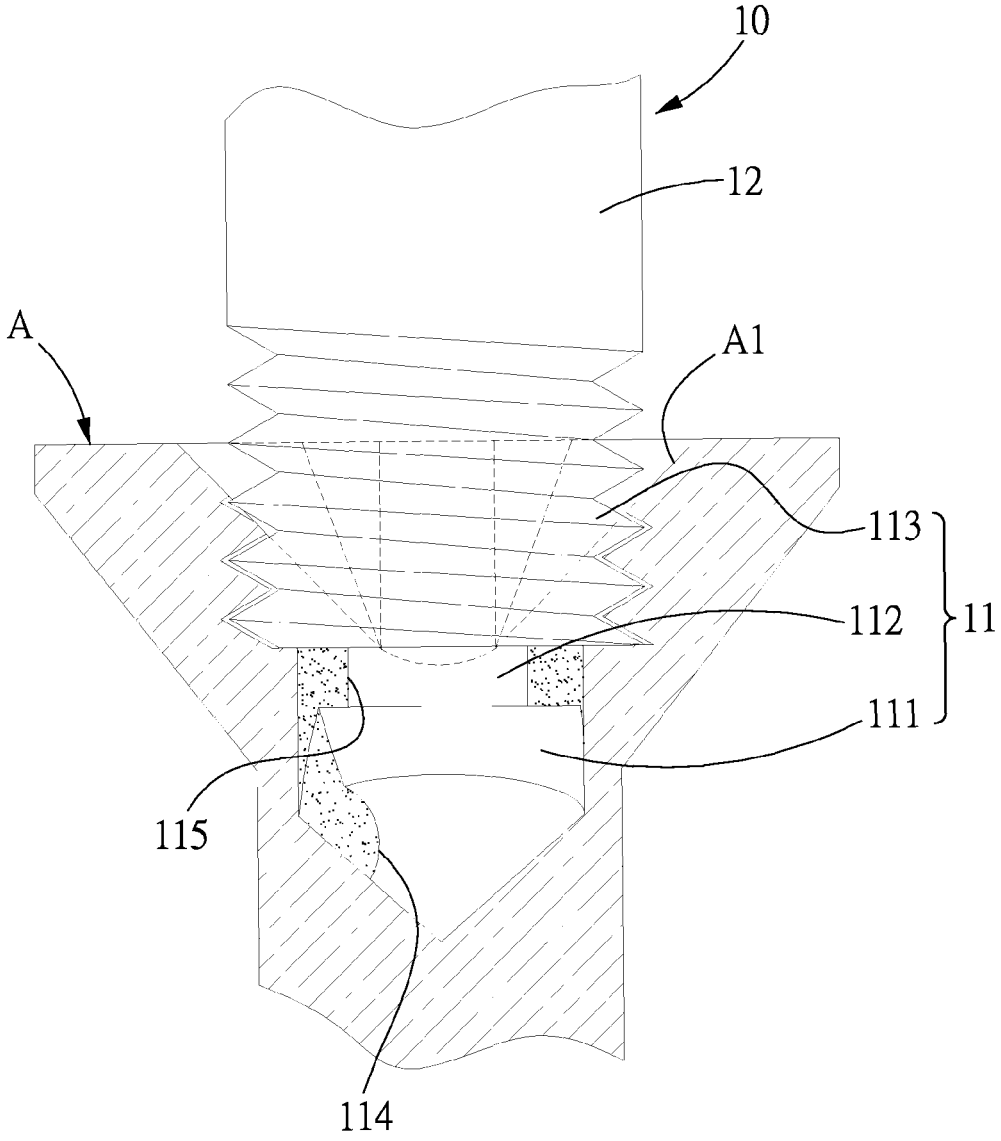
FIG.1 PRIOR ART
FIG. 1 is an illustrative view of a conventional bit for removing screws.
Figure 2:
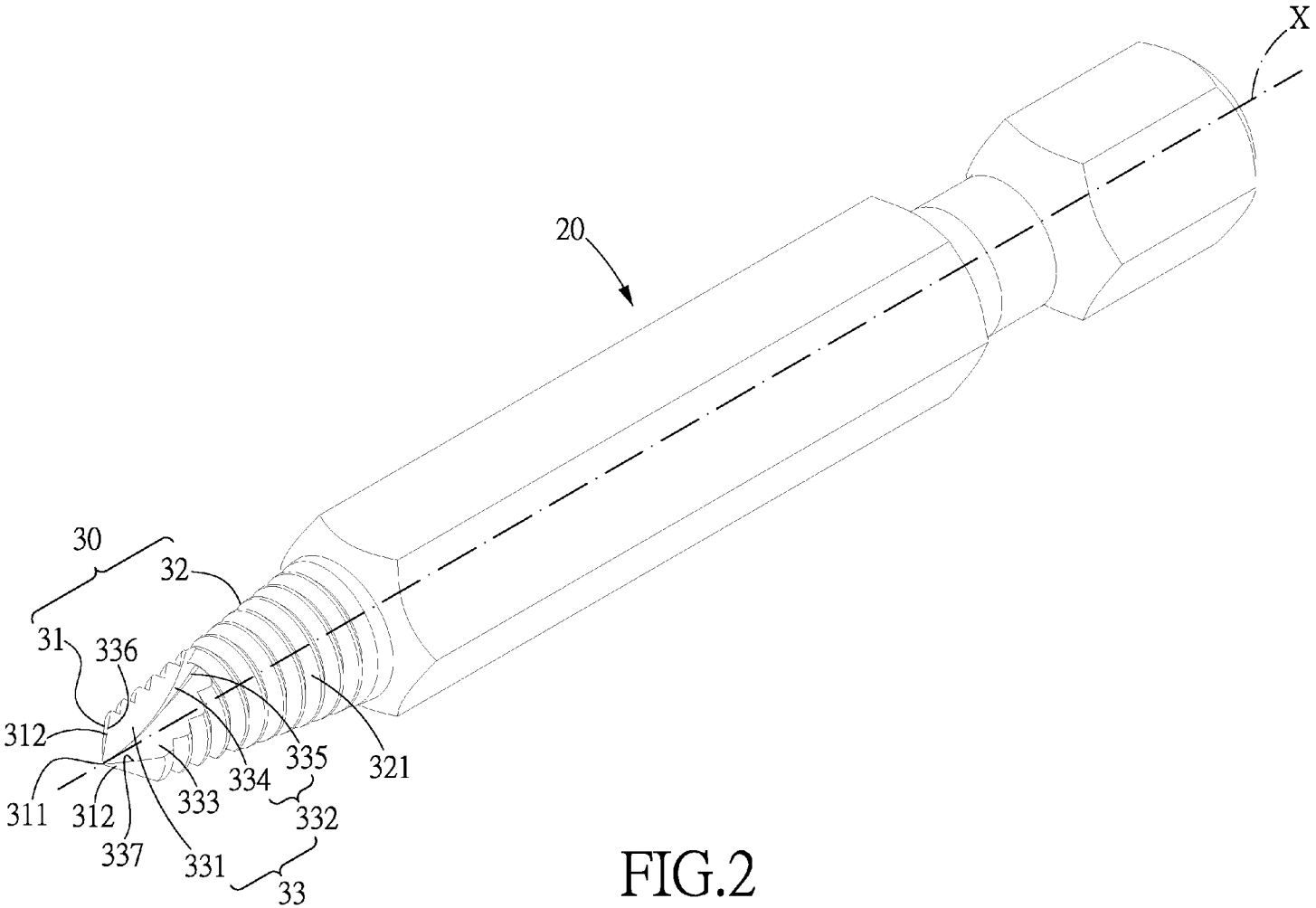
FIG. 2 is a perspective view of a bit for removing damaged screws in accordance with an embodiment of the present invention.
Figure 3:
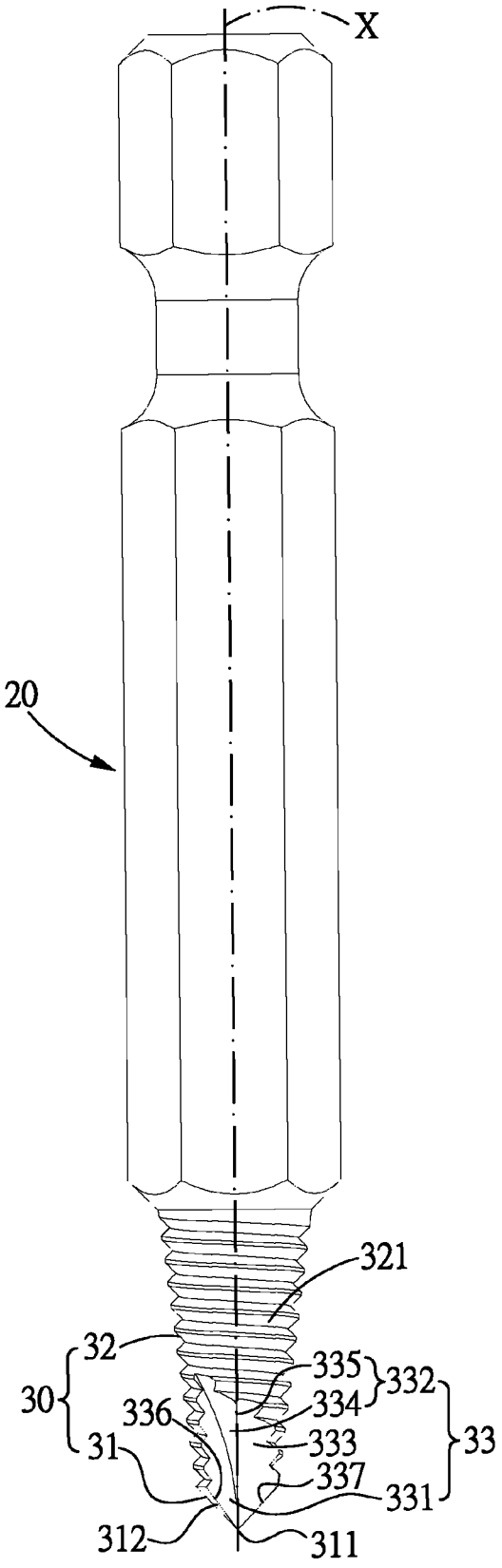
FIG. 3 is a plan view of the bit for removing damaged screws in accordance with the present invention.
Figure 4:
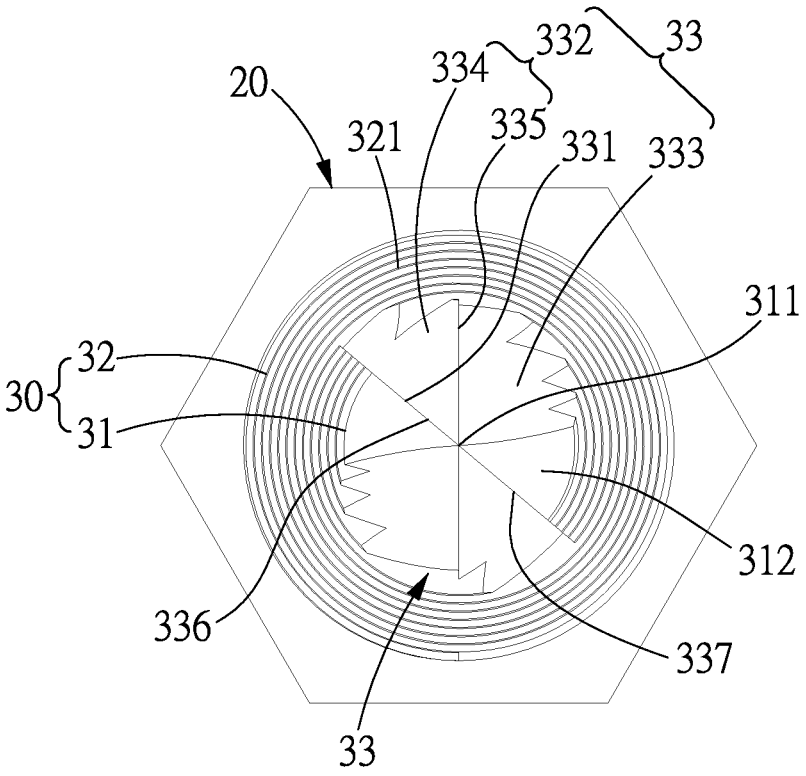
FIG. 4 is an end view of the bit for removing damaged screws in accordance with the present invention.
Figure 5:
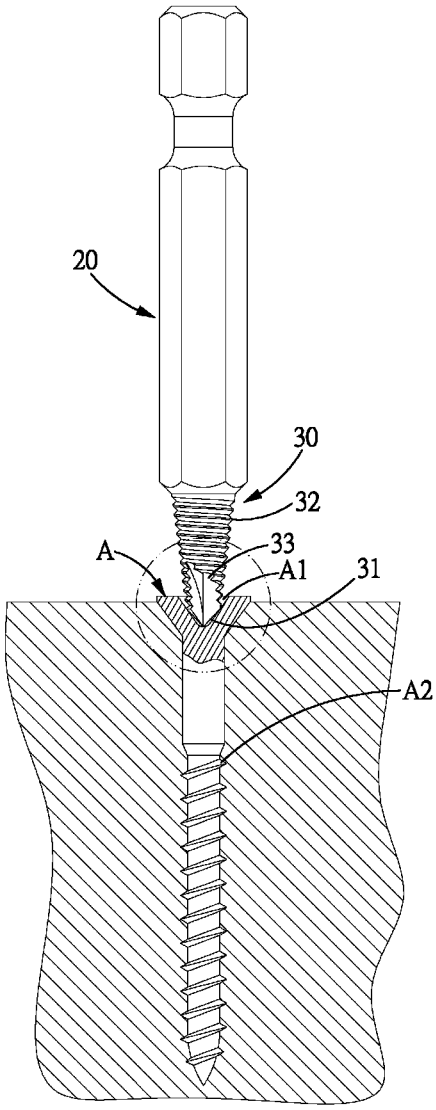
FIG. 5 is an operational view of the bit for removing damaged screws in accordance with the present invention.
Figure 6:
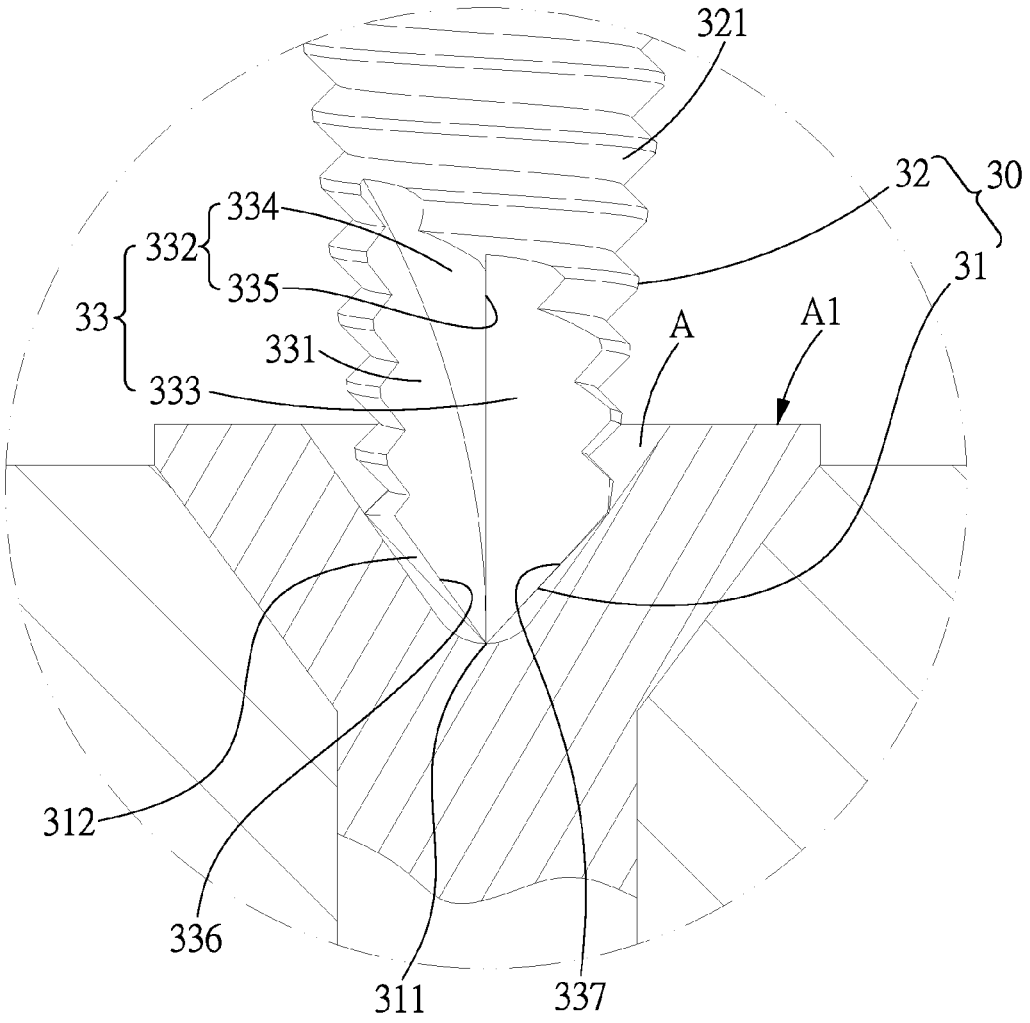
FIG. 6 is an enlarged view of a part of FIG. 5.
Figure 7:
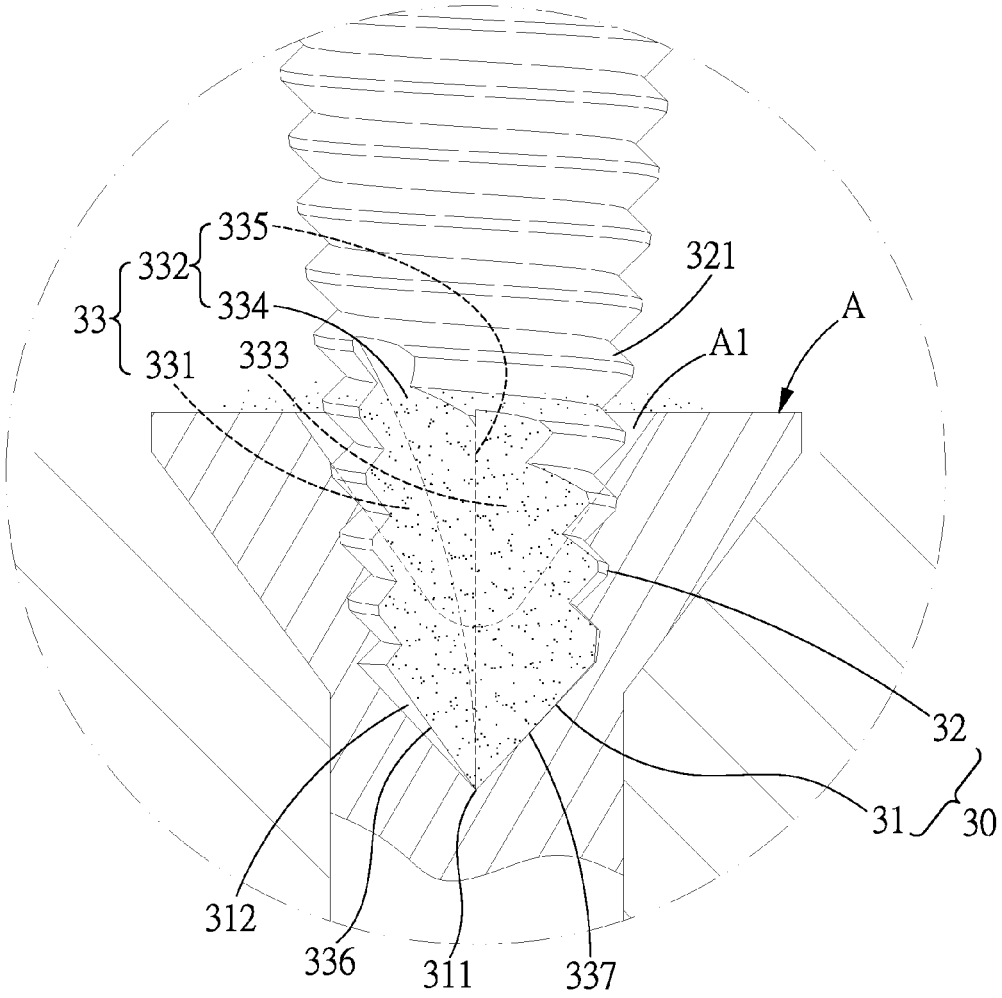
FIG. 7 is a cross sectional view showing that the bit for removing damaged screws in accordance with the present invention is engaged with a damaged screw.
Figure 8:
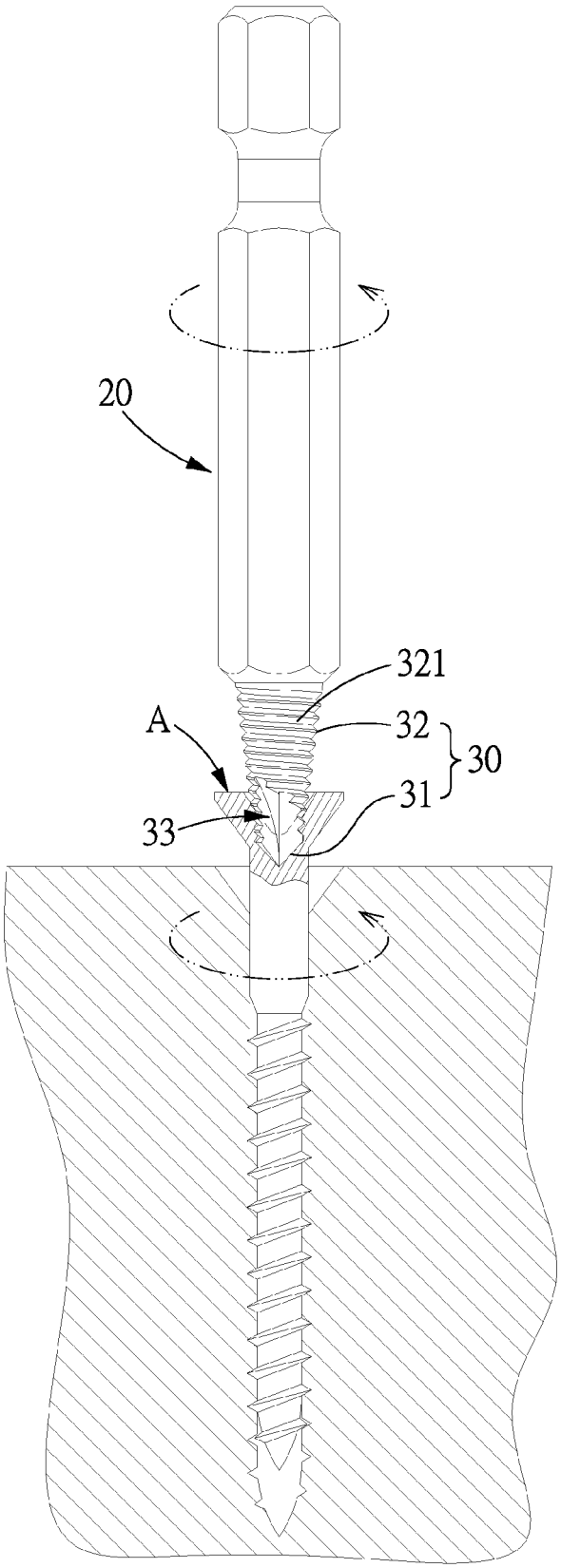
FIG. 8 is an operational view showing that a damaged screw is being rotated by the bit for removing damaged screws in accordance with the present invention.

Referring to FIGS. 2-8, a bit for removing damaged screws in accordance with an embodiment of the present invention is used to remove a damaged screw A. The damaged screw A includes a damaged driving groove A1 and a screw thread A2. The bit of the present invention comprises: a shaft portion 20 and a head portion 30 connected to the shaft portion 20. The head portion 30 includes a middle axis X and is provided with a tip section 31 and a threaded conical section 32 connected between the tip section 31 and shaft portion 20. The tip section 31 includes a vertex point 311. The outer peripheral surface of the threaded conical section 32 defines an angle with respect to the middle axis X. The threaded conical section 32 expands toward the shaft portion 20, and is a conical structure with a reverse thread 321 which rotates oppositely to the rotation of the screw thread A2.

The head portion 30 is provided with two symmetrical scraping portions 33 extending continuously from the tip section 31 to the threaded conical section 32. The two scraping portions 33 define two relief surfaces 312 with respect to the tip section 31, and each include a first scraping surface 331, a residual portion 332 and a second scraping surface 333. The residual portion 332 is a structure formed at the connection where the first and second scraping surfaces 331, 333 are connected to each other at an angle. The residual portion 332, in this embodiment, is a special conical structure which will be inevitably formed after the first and second scraping surfaces 331, 333 are formed by cutting process. The first scraping surface 331 intersects with the tip section 31, the threaded conical section 32 and a first connecting surface 334 of the residual portion 332. A first scraping edge 336 is formed at a position where the first scraping surface 331 intersects the tip section 31, and extends between the vertex point 311 and the threaded conical section 32. The second scraping surface 333 intersects with the tip section 31, the threaded conical section 32 and a second connecting surface 335 of the residual portion 332. A second scraping edge 337 is formed at a position where the second scraping surface 333 intersects the tip section 31, and extends between the vertex point 311 and the threaded conical section 32.

The first and second scraping edges 336, 337 are brought into contact with the driving groove A1 of the damaged screw A, then the bit rotates to make the first and second scraping edges 336, 337 bite into the driving groove A1. Since the threaded conical section 32 is connected to the tip section 31, and the scraping portions 33 extend from the tip section 31 all the way to the threaded conical section 32, the scraping operation performed by the scraping portions 33 is not limited within the area of the tip section 31, and can extend to the threaded conical section 32.

Therefore, the threaded conical section 32 will come into contact with the driving groove A1 to perform scraping right after the first and second scraping edges 336, 337 of the tip section 31 scrape the driving groove A1. At this moment, the scraping portions 33 which extend to the threaded conical section 32 can continuously perform scraping operation toward the driving groove A1, and is able to expand scraping area as the conical size of the threaded conical section 32 changes, so as to scrape out a space big enough to allow passage of the threaded conical section 32, thus reducing resistance when the threaded conical section 32 performs scraping and cutting operation.

Meanwhile, the rotation of the bit makes the threaded conical section 32 continuously scrape out a threaded hole in the driving groove A1. Since the threaded conical section 32 is a conical structure with a reverse thread 321 which rotates oppositely to the rotation of the screw thread A2, when the bit screws into the damaged screw A, the damaged screw A will be fixed to the bit and unscrewed out as the bit rotates.

It can be learned from the above description that the bit of the present invention is provided with the tip section 31, the adjoining threaded conical section 32, and the scraping portions 33 continuously extending from the tip section 31 to the threaded conical section 32. The tip section 31 starts the scraping firstly, and the scraping operation extends to the threaded conical section 32. Then the threaded conical section 32 follows the continuous scraping of the tip section 31 to scrap out a thread which further guides the threaded conical section 32 move forward and into the damaged screw A, which allows the scraping and screwing operation to be performed more smoothly, and improves the convenience of use of the bit.

In addition to the first and second scraping surfaces 331, 333, the bit of the present invention is further provided with the residual portion 332 inevitably formed after the first and second scraping surfaces 331, 333 are formed by cutting process, so that the scraping portions 33 become a special structure totally different from other conventional bits, which makes the bit of the present invention more recognizable.

Figure 9:
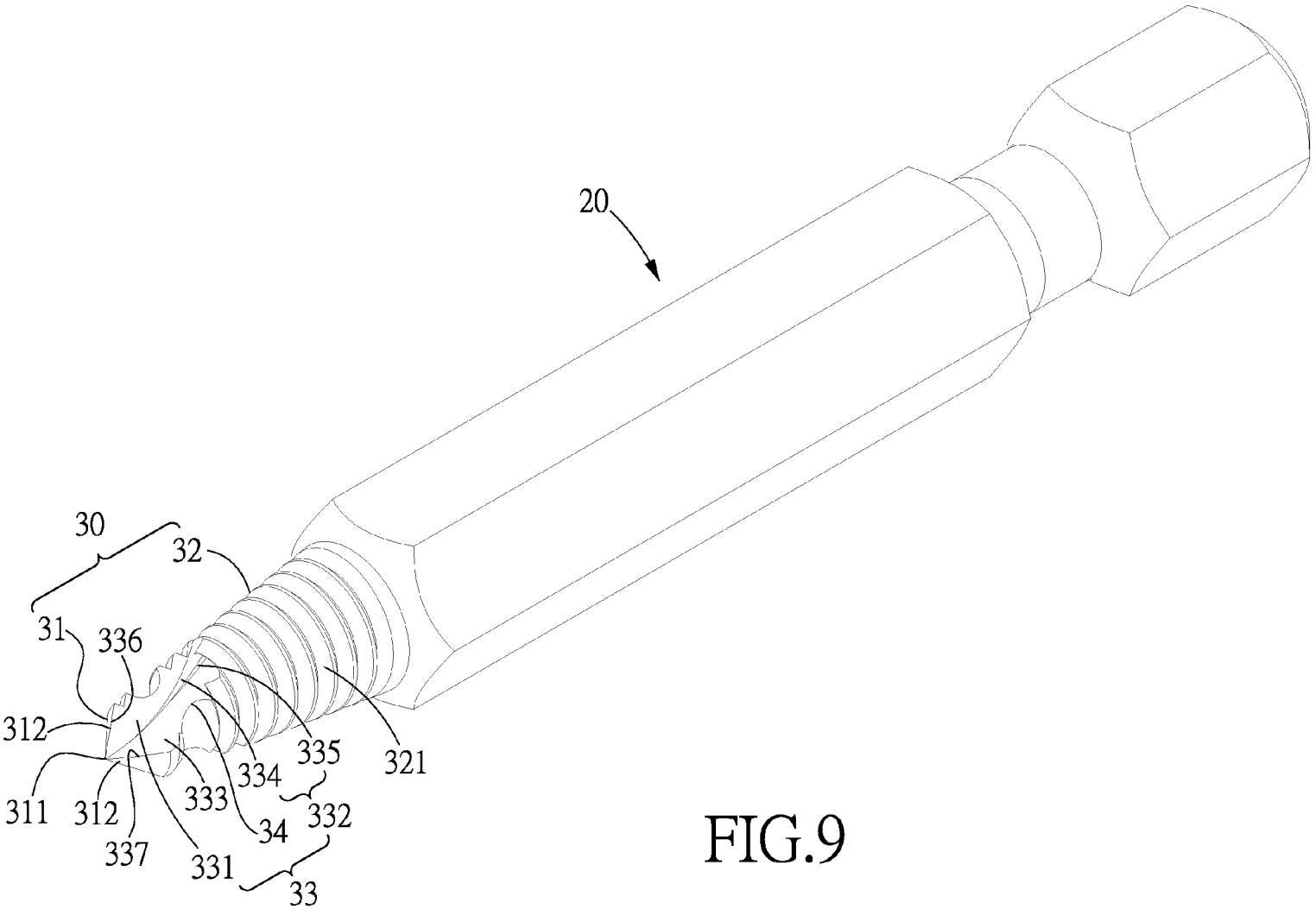
FIG. 9 is a perspective view of a bit for removing damaged screws in accordance with another embodiment of the present invention.
Figure 10:
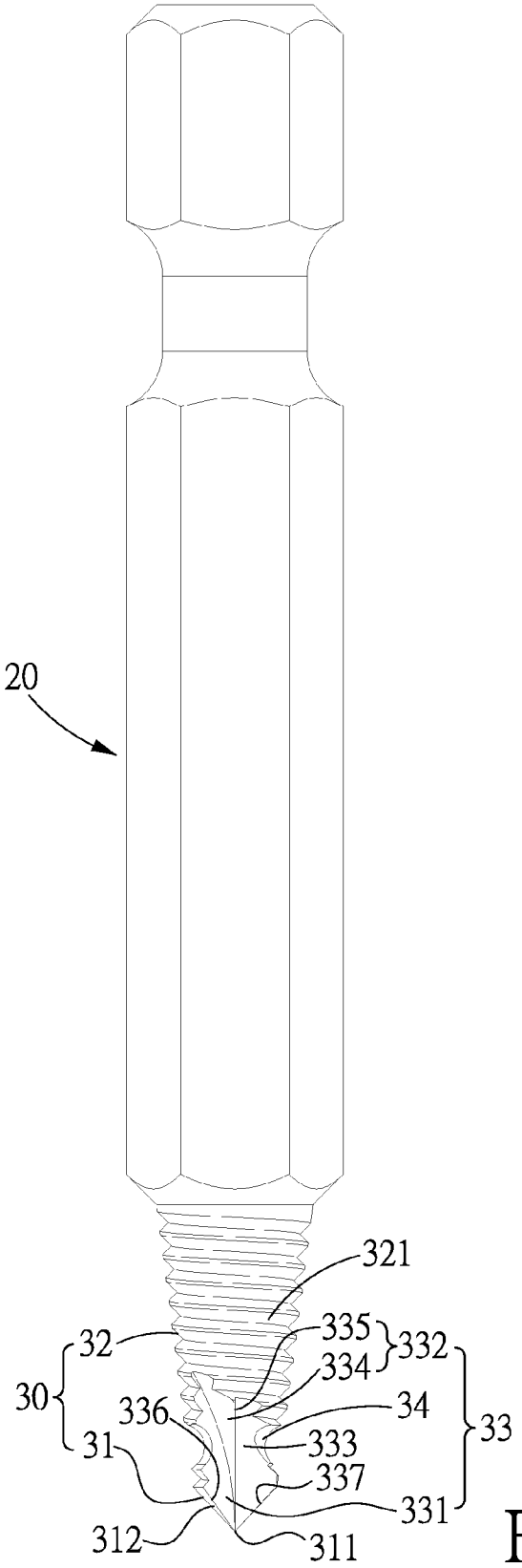
FIG. 10 is a plan view of FIG. 9.
Figure 11:
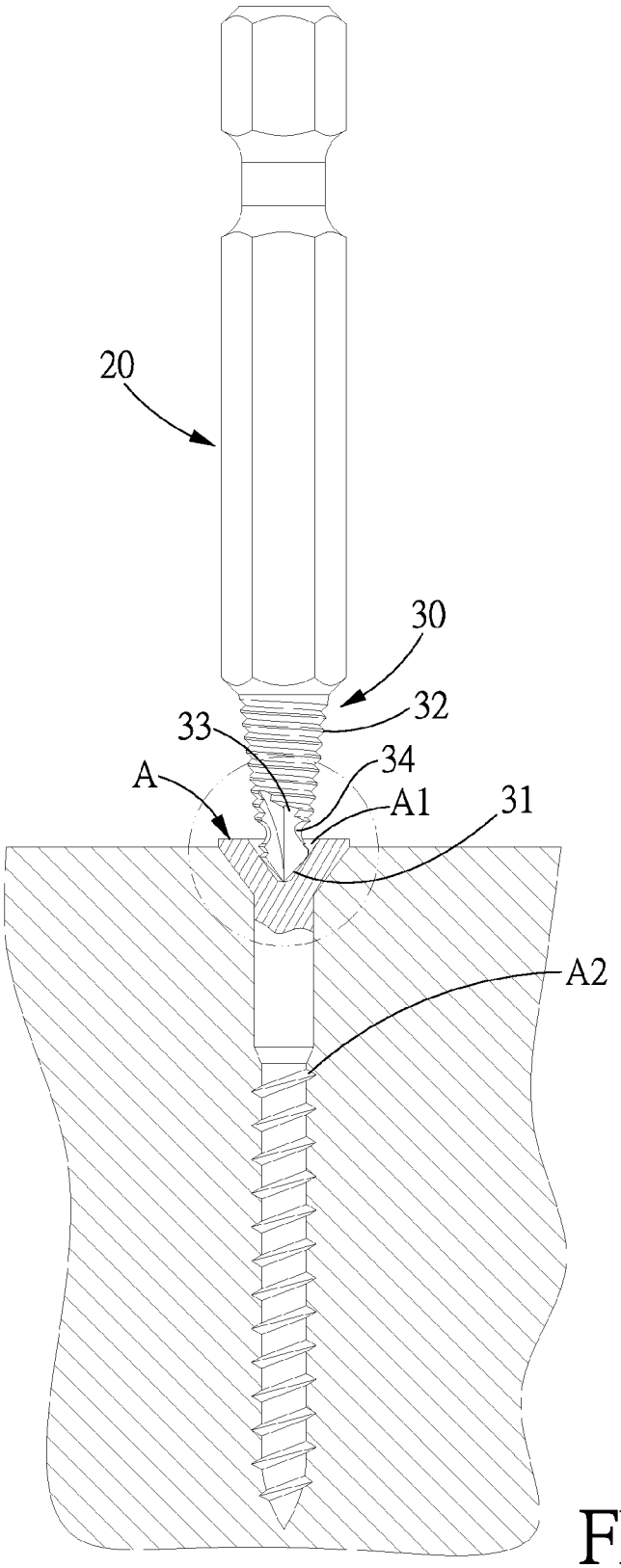
FIG. 11 is an operational view of the bit for removing damaged screws in accordance with another embodiment of the present invention.
Figure 12:
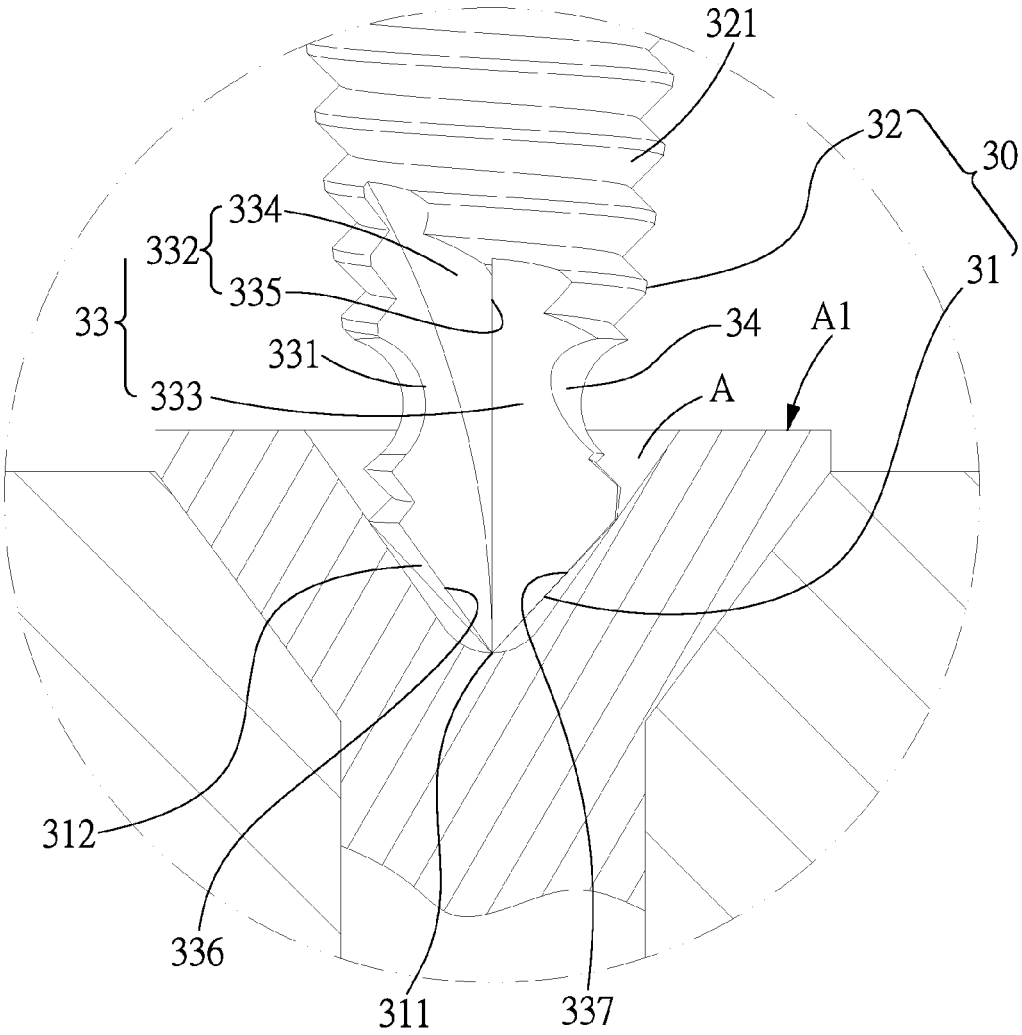
FIG. 12 is an enlarged view of a part of FIG. 11.
Figure 13:
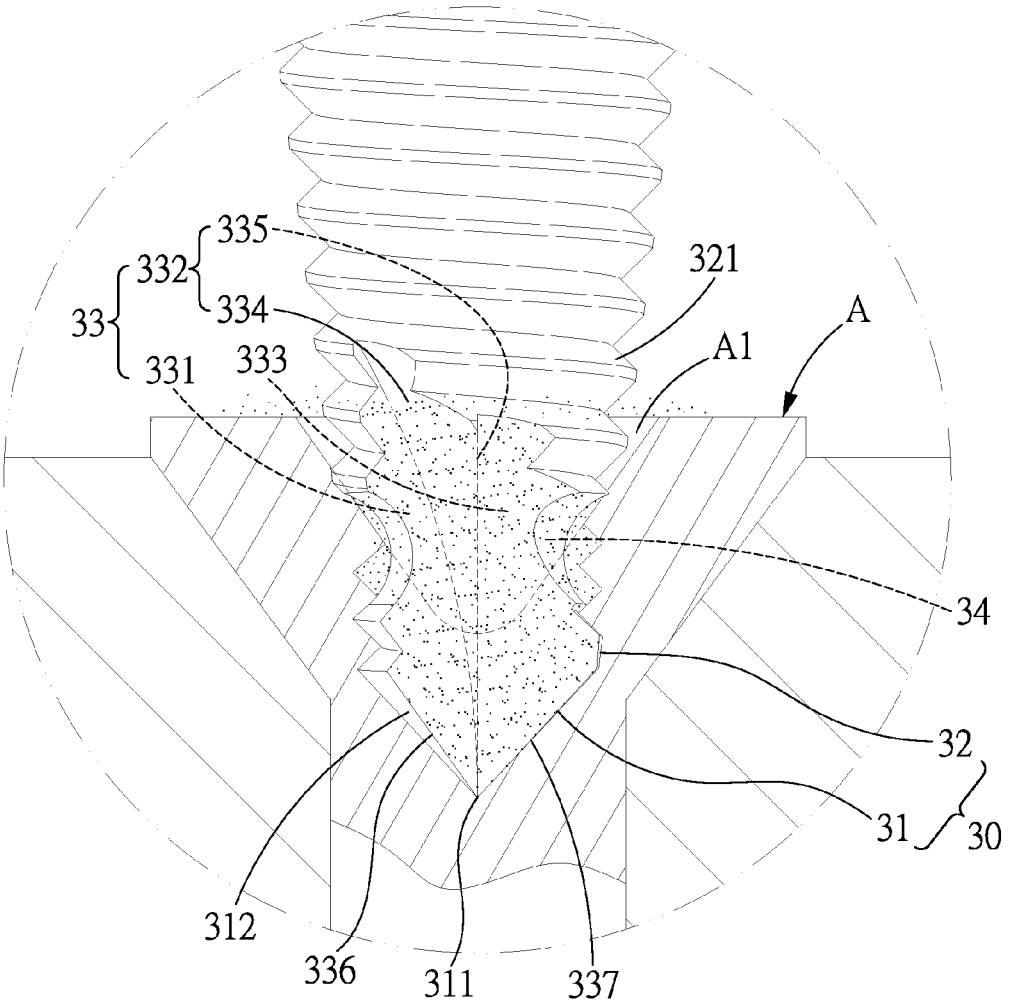
FIG. 13 is a cross sectional view showing that the bit for removing damaged screws in accordance with another embodiment of the present invention is engaged with a damaged screw.
Figure 14:
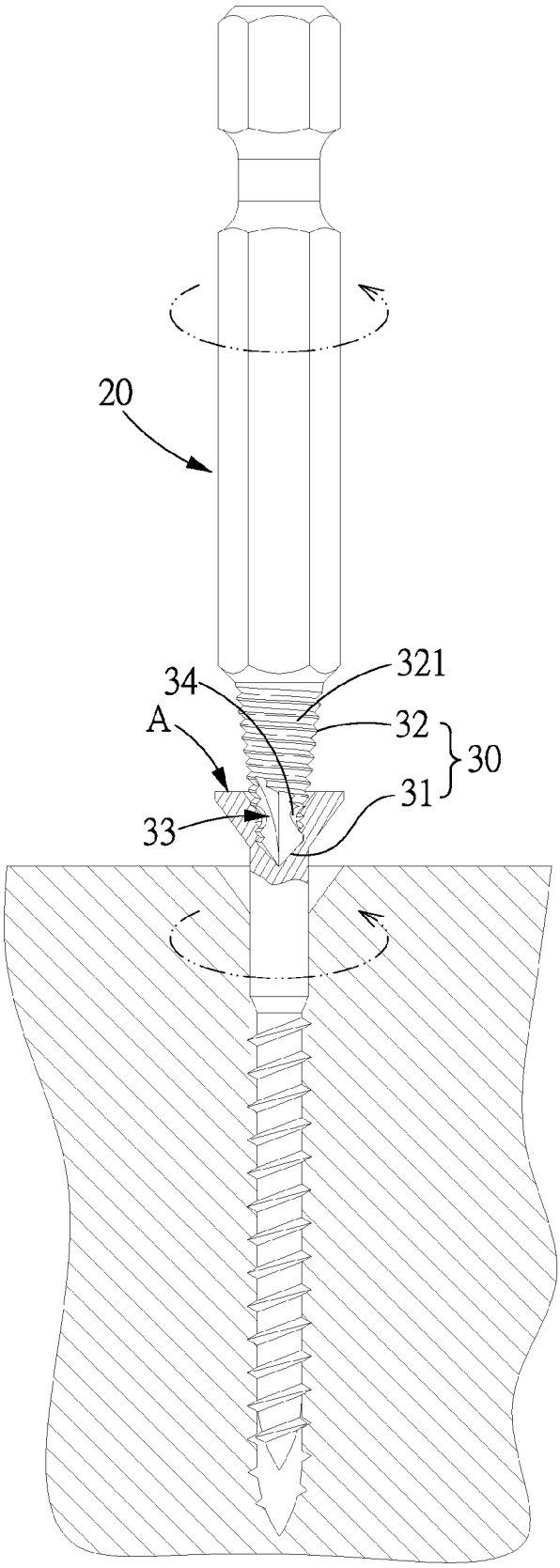
FIG. 14 is an operational view showing that a damaged screw is being rotated by the bit for removing damaged screws in accordance with another embodiment of the present invention.

Referring then to FIGS. 9-14, a bit for removing damaged screws in accordance with another embodiment of the present invention is similar to the first embodiment, except that: the threaded conical section 32 of the head portion 30 is further provided with a shrinking neck section 34 which is connected to the scraping portions 33. The diameter at both ends of the shrinking neck section 34 is smaller than the diameter of the connection between the threaded conical section 32 and the shrinking neck section 34. The operation of this embodiment is the same the previous embodiment, as shown in FIGS. 11-14. Chips produced during scraping process can be discharged from the shrinking neck section 34, which enables the scraping to be performed more smoothly. Besides, the shrinking neck section 34 does not affect the continuation of scraping operation since it is connected to the scraping portions 33, thus solving the problem of the conventional bit that the scraping operation will be interrupted by the shrinking neck section 34 and cause resistance increase during scraping.

While we have shown and described various embodiments in accordance with the present invention, it is clear to those skilled in the art that further embodiments may be made without departing from the scope of the present invention.

What is claimed is:

1. A bit for removing damaged screws comprising: a shaft portion and a head portion connected to the shaft portion, the head portion including a middle axis and being provided with a tip section and a threaded conical section connected between the tip section and shaft portion, the tip section including a vertex point, an outer peripheral surface of the threaded conical section defining an angle with respect to the middle axis, the threaded conical section expanding toward the shaft portion, and being a conical structure with a reverse thread, the bit being characterized in that;

the head portion is provided with two symmetrical scraping portions extending continuously from the tip section to the threaded conical section, the two scraping portions each include a first scraping surface, a residual portion and a second scraping surface, the residual portion is a structure formed at a connection where the first and second scraping surfaces are connected to each other at an angle, the first scraping surface intersects with the tip section, the threaded conical section and a first connecting surface of the residual portion, a first scraping edge is formed at a position where the first scraping surface intersects the tip section, and extends between the vertex point and the threaded conical section, the second scraping surface intersects with the tip section, the threaded conical section and a second connecting surface of the residual portion, a second scraping edge is formed at a position where the second scraping surface intersects the tip section, and extends between the vertex point and the threaded conical section.

2. The bit for removing damaged screws as claimed in claim 1, wherein the threaded conical section of the head portion is further provided with a shrinking neck section which is connected to the scraping portions, and the diameter at both ends of the shrinking neck section is smaller than a diameter of the connection between the threaded conical section and the shrinking neck section.

* * * * *